US009580237B2

(12) United States Patent
Nolan et al.

(10) Patent No.: US 9,580,237 B2
(45) Date of Patent: Feb. 28, 2017

(54) COLLAPSIBLE HOPPER BIN

(71) Applicant: ORBIS Corporation, Oconomowoc, WI (US)

(72) Inventors: Roger Nolan, Seymour, IN (US); Link Jay Greiveldinger, Menomonee Falls, WI (US); Leslie Allen Wagner, Mukwonago, WI (US); Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 14/477,089

(22) Filed: Sep. 4, 2014

(65) Prior Publication Data

US 2015/0069054 A1 Mar. 12, 2015

Related U.S. Application Data

(60) Provisional application No. 61/875,277, filed on Sep. 9, 2013.

(51) Int. Cl.

| | |
|---|---|
| ***B65D 47/00*** | (2006.01) |
| ***B65D 88/30*** | (2006.01) |
| ***B65D 88/52*** | (2006.01) |
| ***B65D 90/58*** | (2006.01) |

(52) U.S. Cl.

CPC ..... *B65D 88/30* (2013.01); *B65D 88/522* (2013.01); *B65D 90/587* (2013.01)

(58) Field of Classification Search

CPC ..... B65D 88/26; B65D 88/30; B65D 88/52; B65D 88/522; B65D 90/54; B65D 19/18

USPC ..... 222/561, 460–462; 260/600, 503, 509, 260/511; 220/6, 7, 4.26–4.32

See application file for complete search history.

(56) References Cited

U.S. PATENT DOCUMENTS

| | | | | | |
|---|---|---|---|---|---|
| 4,735,330 | A * | 4/1988 | Hoss | B65D 7/26 | 220/1.5 |
| 4,967,927 | A * | 11/1990 | Reiland | B65D 11/1833 | 220/817 |
| 5,094,356 | A * | 3/1992 | Miller | B65D 11/1833 | 206/509 |
| 5,845,799 | A * | 12/1998 | Deaton | B65D 19/18 | 220/1.5 |

(Continued)

FOREIGN PATENT DOCUMENTS

| | | | | |
|---|---|---|---|---|
| GB | 2357078 A * | 6/2001 | | B65D 19/18 |
| WO | WO 2013/167154 A1 * | 11/2013 | | B65D 19/18 |

*Primary Examiner* — Lien Ngo
(74) *Attorney, Agent, or Firm* — Nixon Peabody LLP

(57) ABSTRACT

In one embodiment, the present invention provides a collapsible hopper bin having a dispensing portion and a storage portion. The dispensing portion includes first and second opposing side walls and first and second opposing end walls. The storage portion includes first and second opposing side walls and first and second opposing end walls. The storage portion first and second side walls are hingedly attached to the dispensing portion first and second side walls. The storage portion first and second end walls are hingedly attached to the dispensing portion first and second end walls. The collapsible hopper bin has a collapsed position and a filled position. The storage portion first and second end walls and first and second side walls are substantially horizontally flat along the top of the dispensing portion in the collapsed position.

18 Claims, 19 Drawing Sheets

(56) References Cited

U.S. PATENT DOCUMENTS

| | | | | |
|---|---|---|---|---|
| 6,010,022 | A * | 1/2000 | Deaton | B65D 19/18 220/4.03 |
| 8,381,929 | B2 * | 2/2013 | Kellerer | B65D 11/1833 206/600 |
| 8,413,831 | B2 * | 4/2013 | Nolan | B65D 19/18 206/600 |
| 8,915,397 | B2 * | 12/2014 | Petersen | B65D 11/20 220/4.28 |
| RE45,713 | E * | 10/2015 | Oren | D23/202 |
| 2009/0044376 | A1 * | 2/2009 | Nolan | B65D 11/18 16/241 |

* cited by examiner

COLLAPSIBLE HOPPER BIN

CROSS-REFERENCE TO RELATED APPLICATIONS

The present Application claims the benefit of U.S. Provisional Application No. 61/875,277, filed Sep. 9, 2013, the contents of which are incorporated herein by reference.

FEDERALLY SPONSORED RESEARCH OR DEVELOPMENT

N/A

TECHNICAL FIELD

The present invention generally relates to a hopper bin with collapsible side walls and having a discharge for shipping and storing grains, seeds, powders, and other dry goods.

BACKGROUND OF THE INVENTION

Dry goods such as seeds are often shipped and stored in hopper bins. An example of such a hopper bin is shown in U.S. Pat. No. 6,010,022 to Deaton. Deaton discloses a hopper bin with a base and a ring. The ring is secured to the base for in a position for containing a material and detached and inverted so that the ring slides over the base. Deaton does not show a hopper bin with collapsible side walls.

It is important for a hopper bin to be compatible with a number of different types of equipment such as seed tenders and fill stations. The bins must be able to be filled with seed or other dry goods, be shipped with the goods therein, and then dispense the goods upon reaching the intended destination. The bins must also be collapsible to allow for easier and more compact return shipment when empty.

SUMMARY OF THE INVENTION

The present invention provides an improved hopper bin with several advantages over known bins. These advantages include a greater shipping density due to a reduced height of the bin in the collapsed position, easier handling (erecting, collapsing and moving) by a single person, easier reparability, and lid locks.

In one embodiment, the present invention provides a collapsible hopper bin having a dispensing portion and a storage portion. The dispensing portion includes first and second opposing side walls and first and second opposing end walls. The storage portion includes first and second opposing side walls and first and second opposing end walls. The storage portion first and second side walls are hingedly attached to the dispensing portion first and second side walls. The storage portion first and second end walls are hingedly attached to the dispensing portion first and second end walls.

In another embodiment, the hopper bin of the present invention provides a dispensing portion and a storage portion. The dispensing portion includes first and second opposing side walls and first and second opposing end walls. The storage portion includes first and second opposing side walls and first and second opposing end walls. The side walls include a waterproof shield. The shield has a plurality of hinge pockets along a top edge of the dispensing portion side walls, and a corresponding first plurality of cam elements along a bottom edge of the storage portion side walls. The shield also includes a second plurality of cam elements along the top edge of the dispensing portion side walls and corresponding engaging portions along the bottom edge of the storage portion side walls, and an outer overlap overlapping the top edge of the side walls of the dispensing portion.

BRIEF DESCRIPTION OF THE DRAWINGS AND ATTACHMENT

To understand the present invention, it will now be described by way of example, with reference to the accompanying drawings in which.

DETAILED DESCRIPTION

Figure 1:
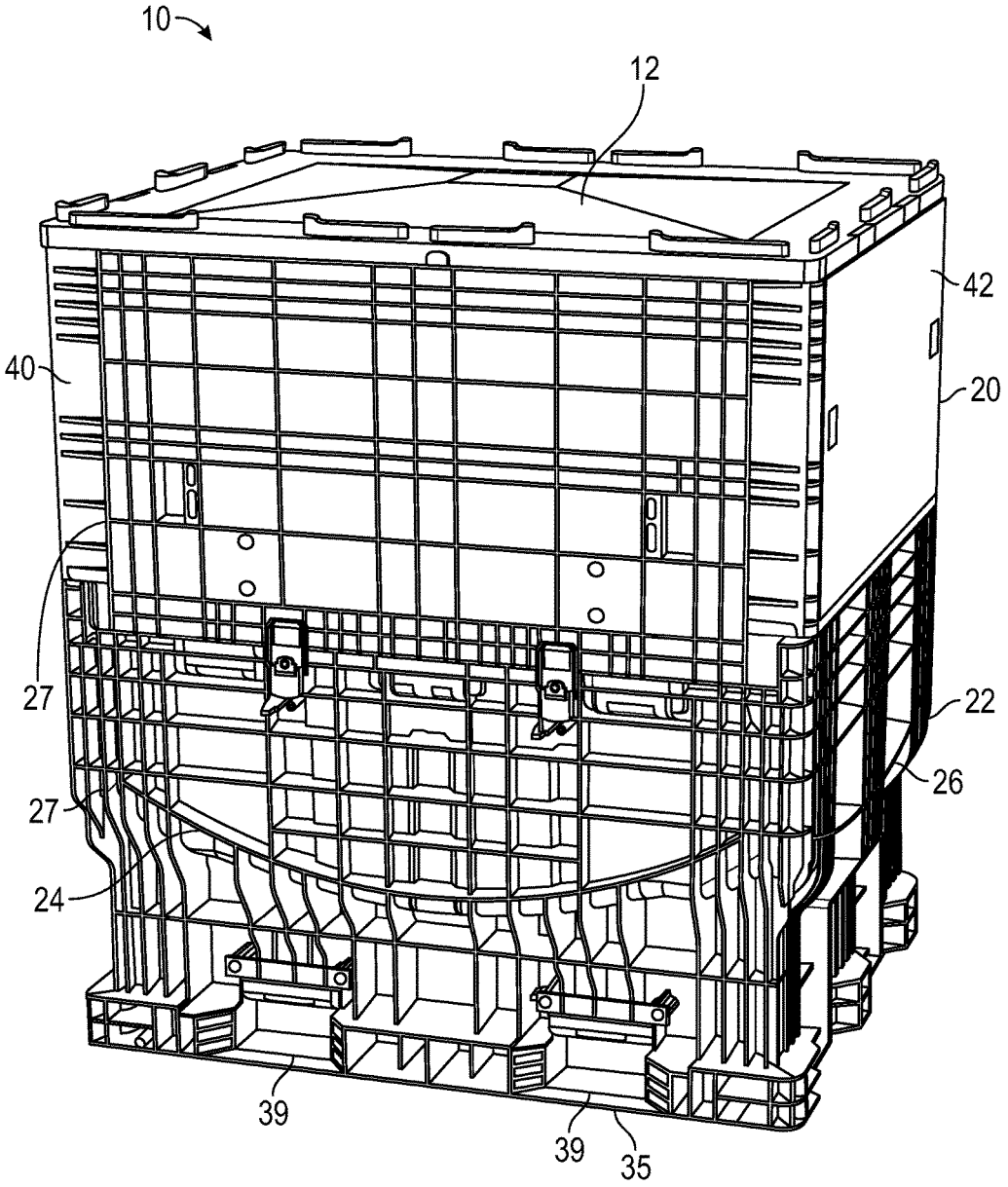
FIG. 1 is a perspective view of collapsible hopper bin in the open position made in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
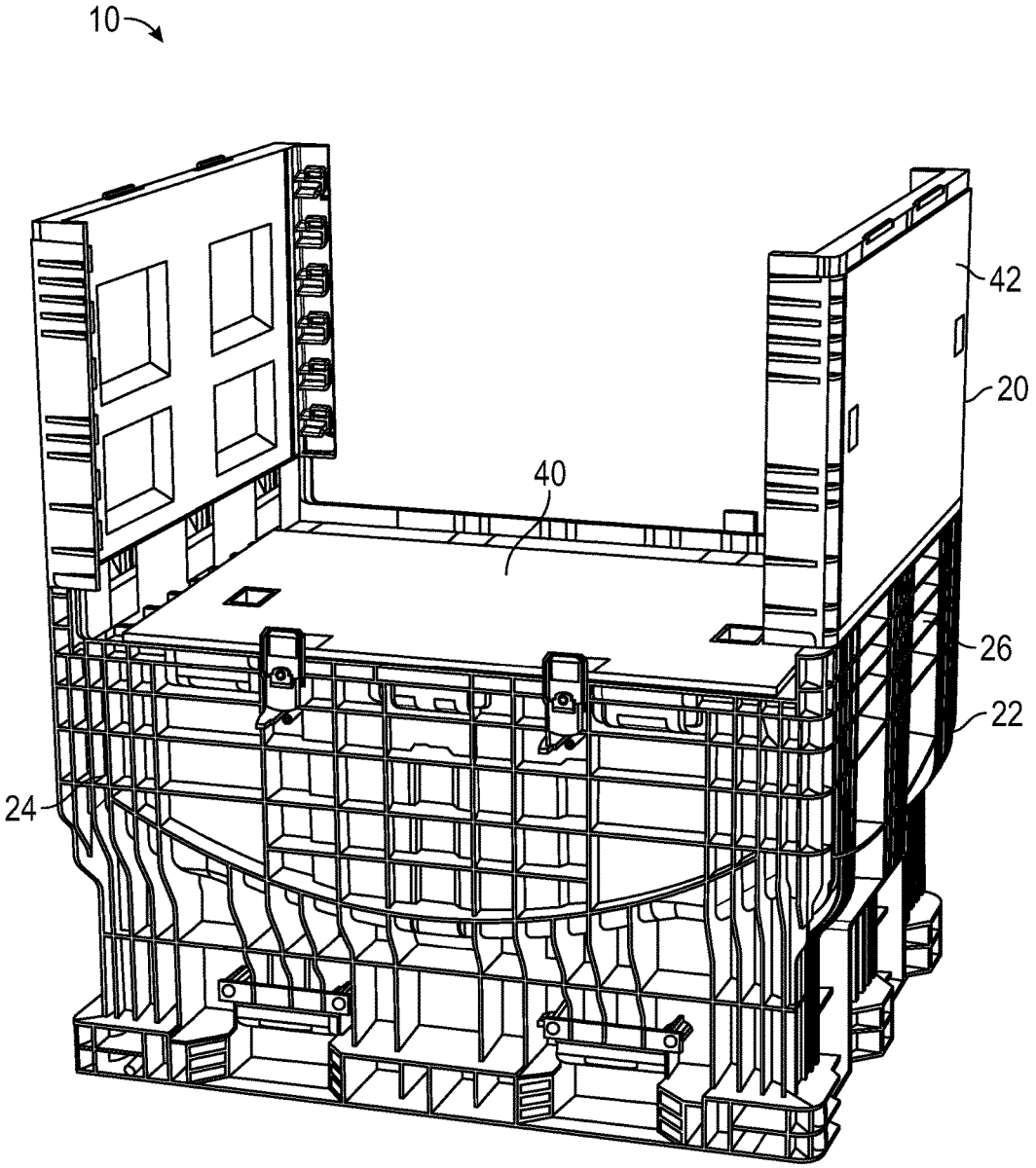
FIG. 2 is a perspective view of collapsible hopper bin in the partially collapsed position made in accordance with the present invention.
Figure 3:
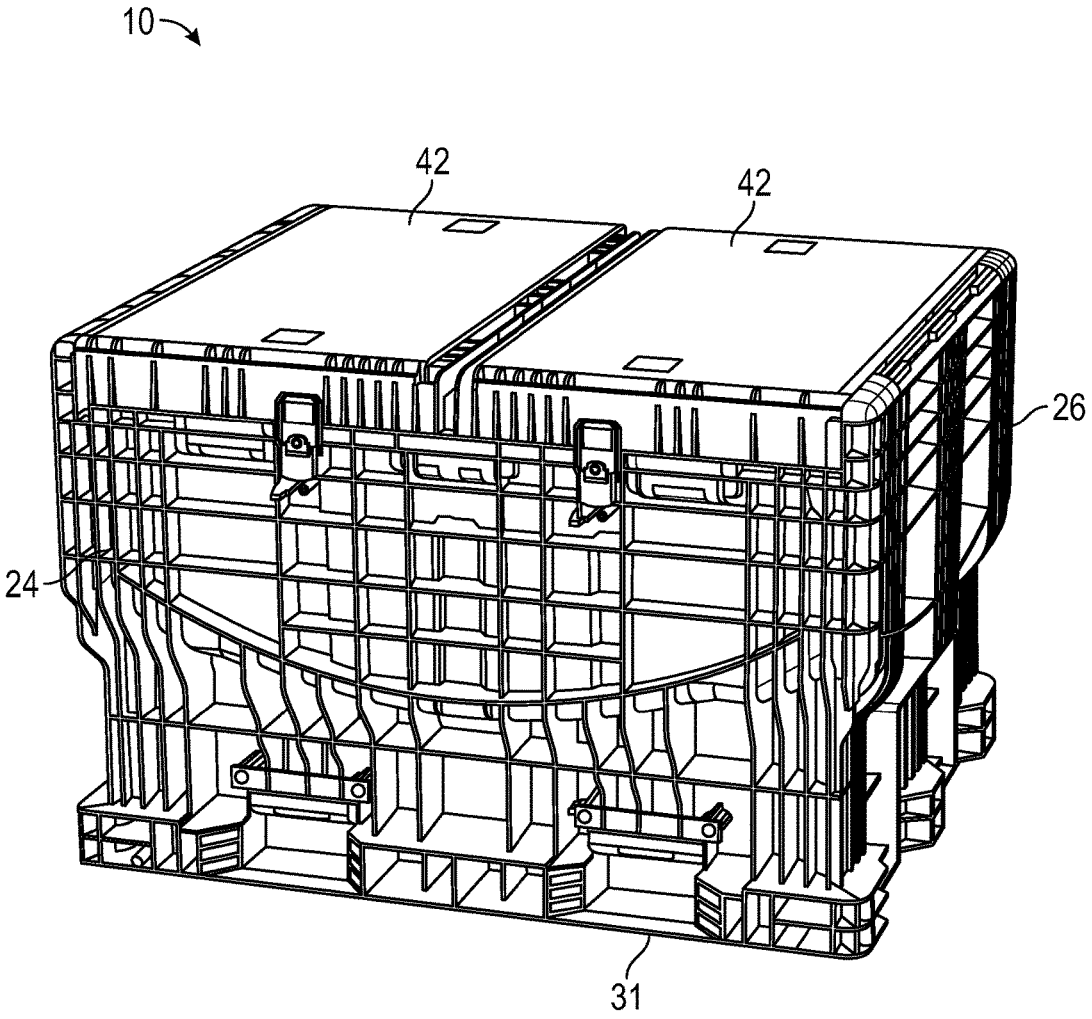
FIG. 3 is a perspective view of collapsible hopper bin in the collapsed position made in accordance with the present invention.

Referring to the FIGS., a collapsible hopper bin 10 is shown in accord with an embodiment of the present invention. FIG. 1 shows the bin 10 in the filled position. FIG. 2 shows the bin 10 in a partially collapsed position. FIG. 3 shows the bin 10 in a fully collapsed position.

Figure 4:
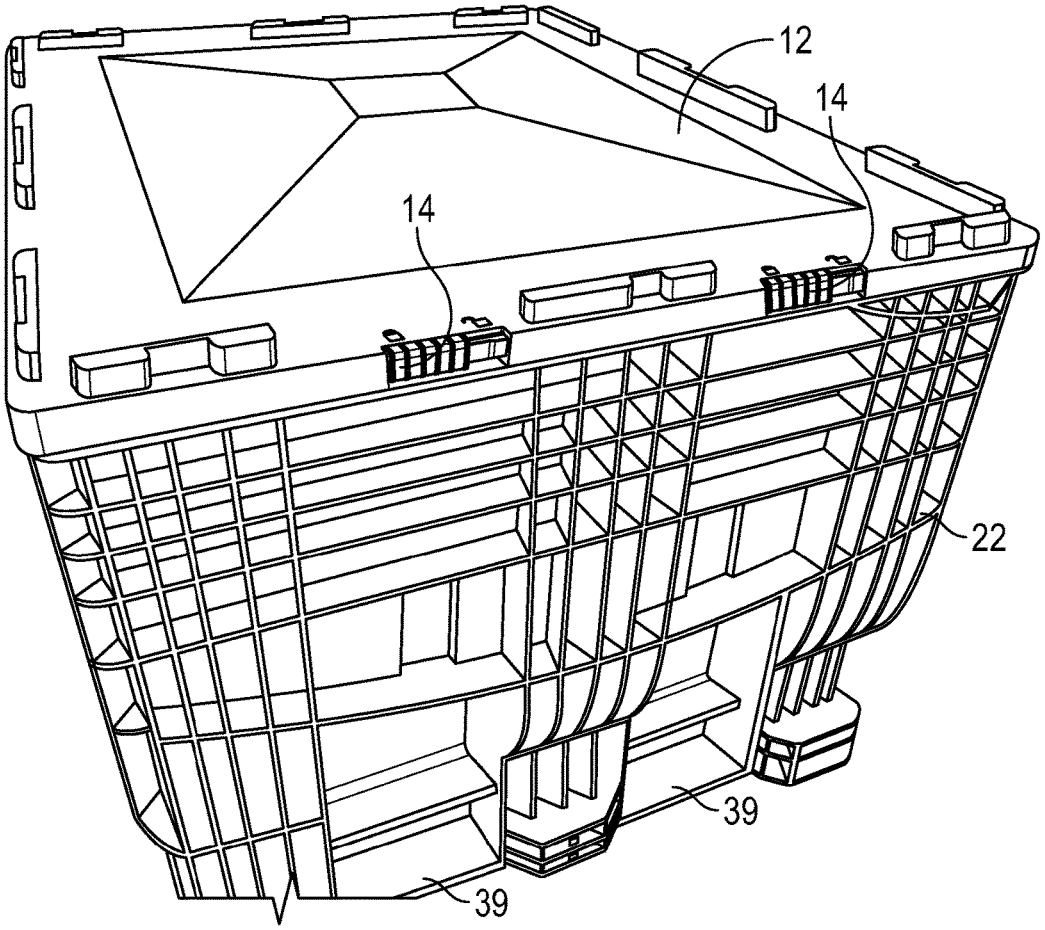
FIG. 4 is a perspective view of collapsible hopper bin in the collapsed position with a lid made in accordance with the present invention.
Figure 5:
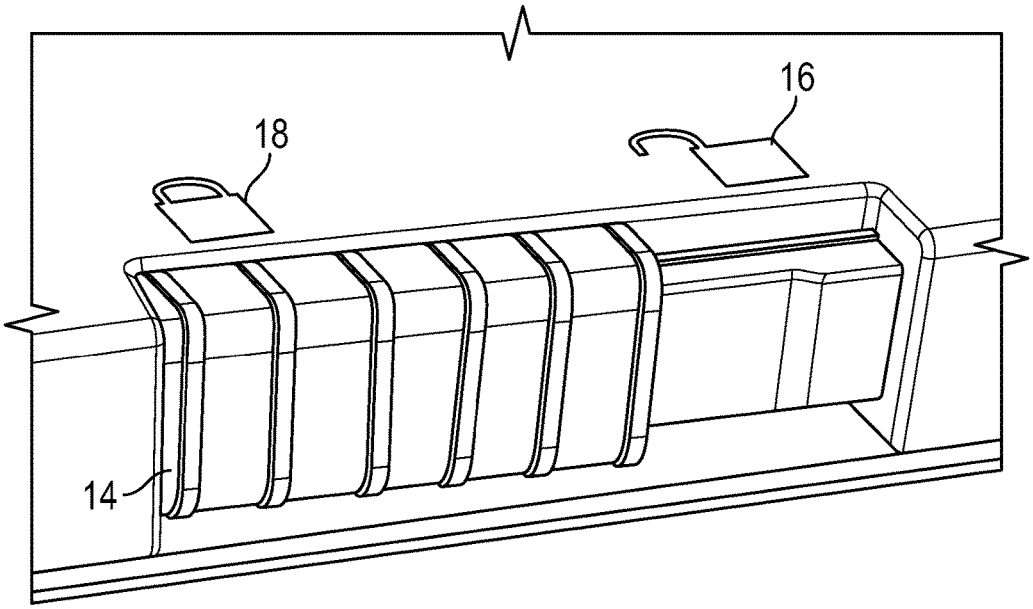
FIG. 5 is a perspective view of a lid locking mechanism made in accordance with the present invention.
Figure 6:
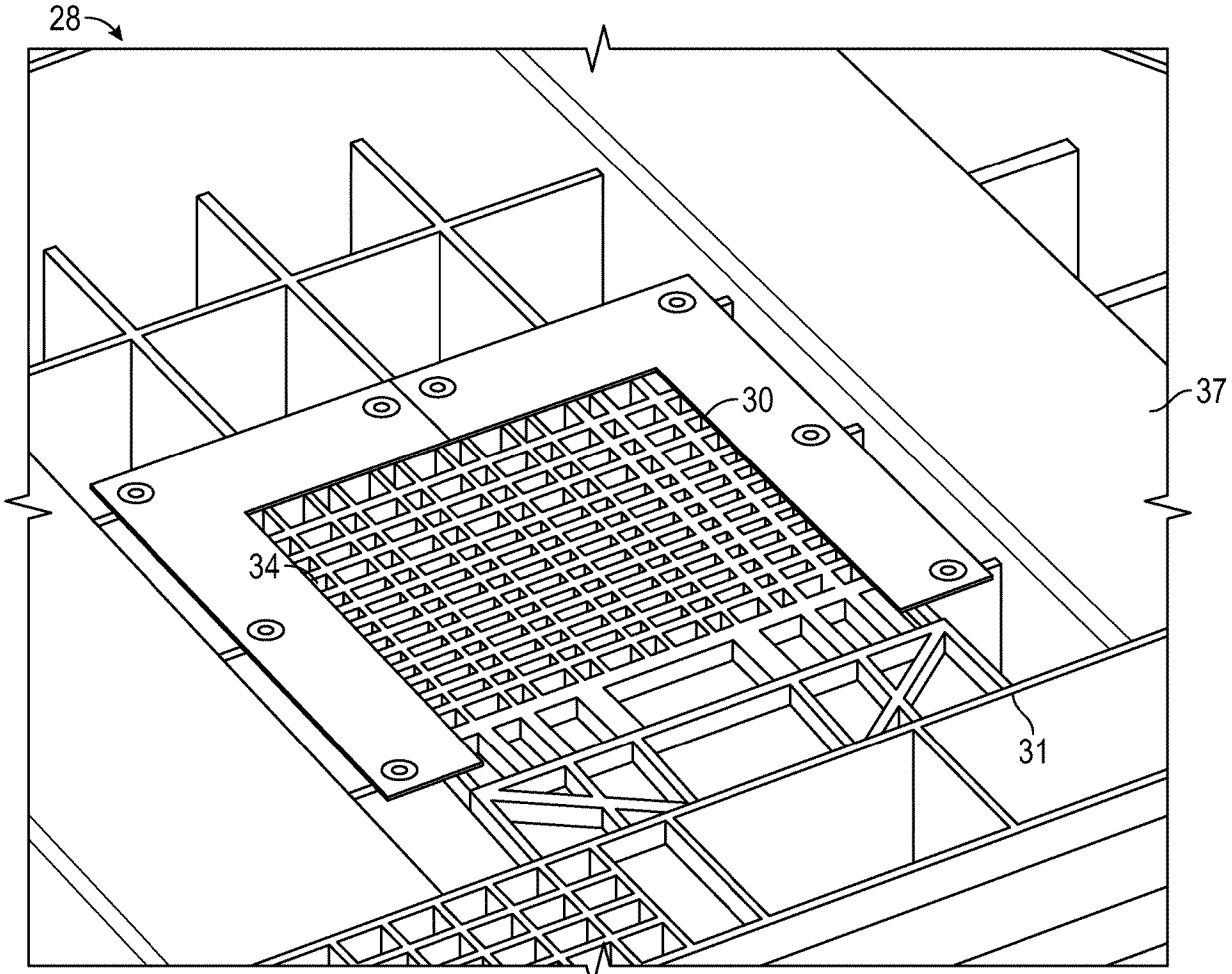
FIG. 6 is a perspective view of a gate assembly made in accordance with the present invention.
Figure 7:
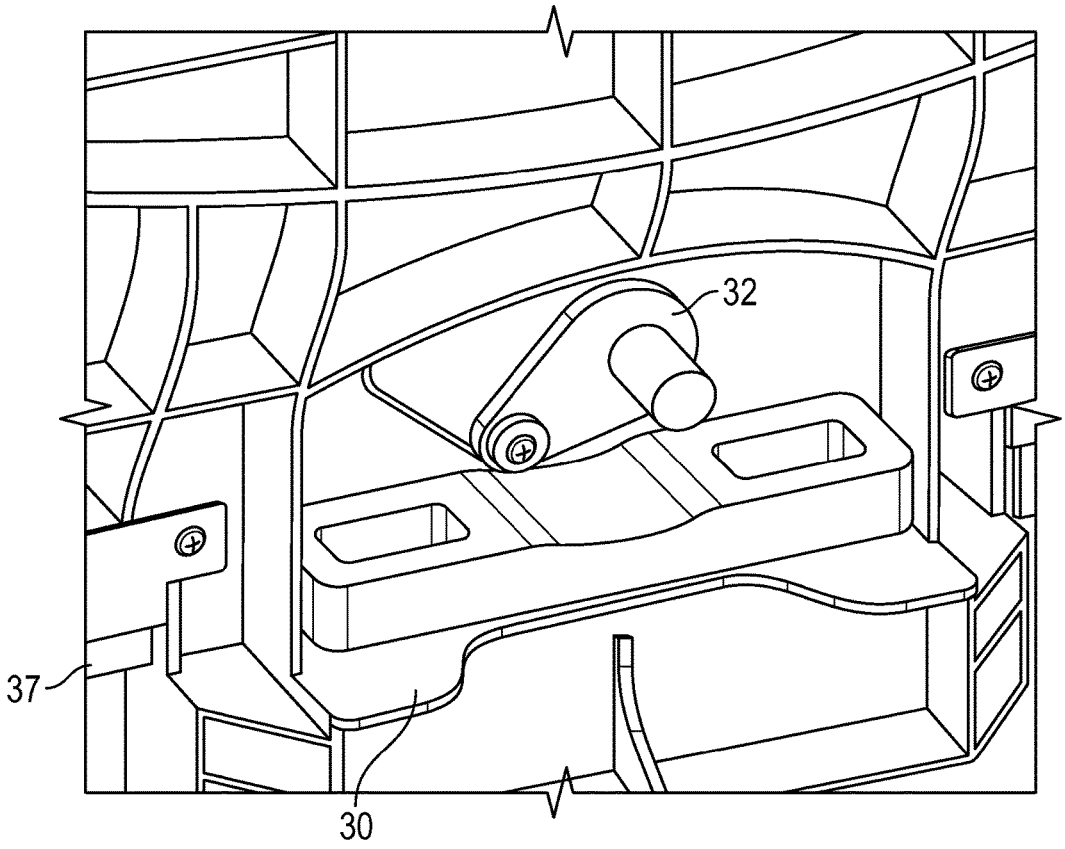
FIG. 7 is a perspective view of a gate assembly made in accordance with the present invention.

FIG. 4 shows the bin 10 in the fully collapsed position with a lid 12. When in the open position of FIG. 1 or the collapsed position of FIG. 4, the lid 12 is secured to the bin 10 by a plurality of locks 14. The locks 14 have an open position 16 and a closed position 18 as shown in FIG. 5.

Figure 11:
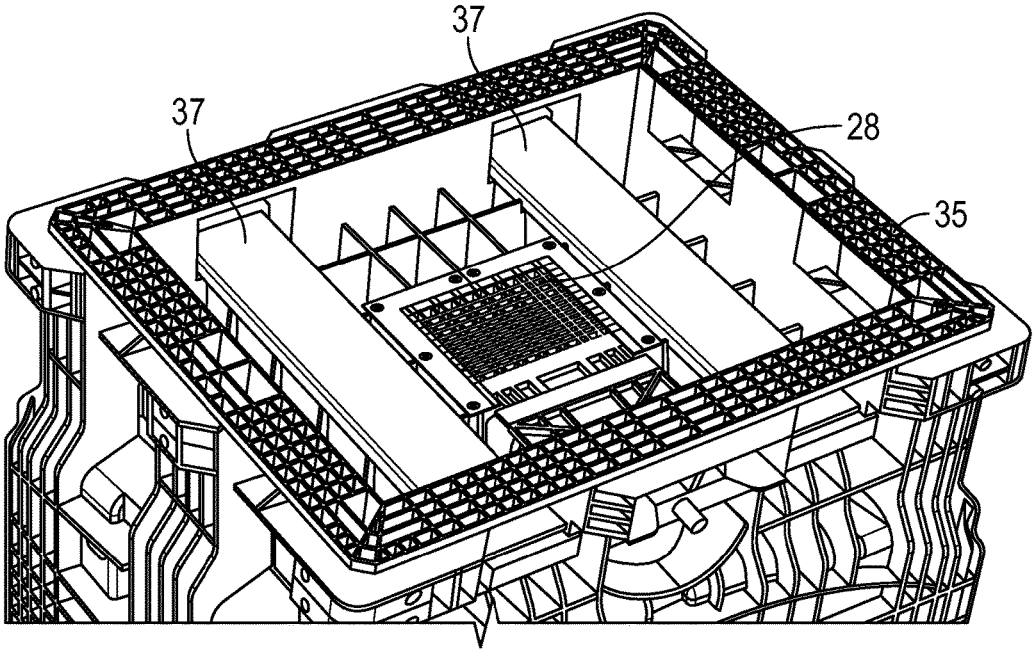
FIG. 11 is a the bottom of the dispensing portion of the collapsible hopper bin made in accordance with the present invention.

The bin 10 has an upper storage portion 20 when in the filled position, and a lower dispensing portion 22. The dispensing portion 22 is preferably made in one piece, and is made of molded structural foam high density polyethylene, and includes first and second opposing side walls 24 and first and second opposing end walls 26. The side walls 24 and end walls 26 of the dispensing portion 22 include ribs 27, which strengthen the walls while minimizing their weight. The bottom of the dispensing portion 22 includes integrally molded feet 35 (FIG. 11).

Figure 8:
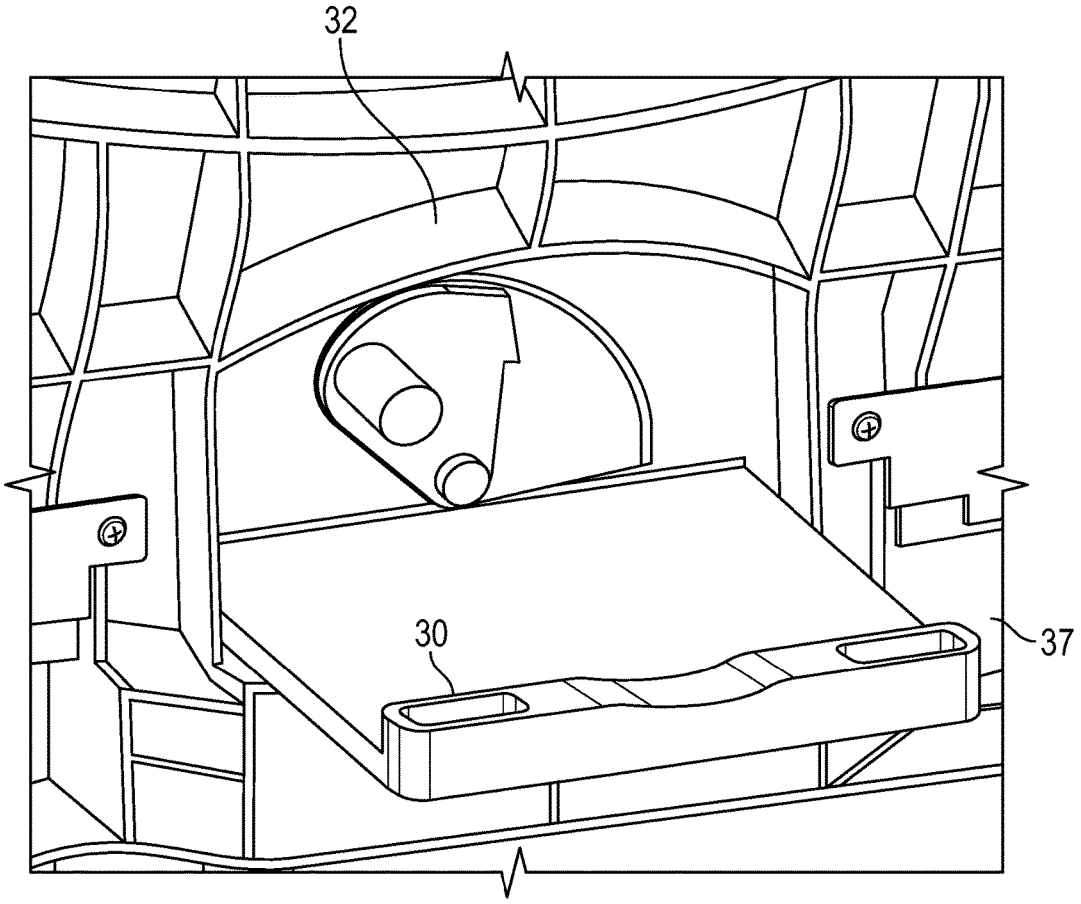
FIG. 8 is a perspective view of a gate assembly made in accordance with the present invention.
Figure 9:
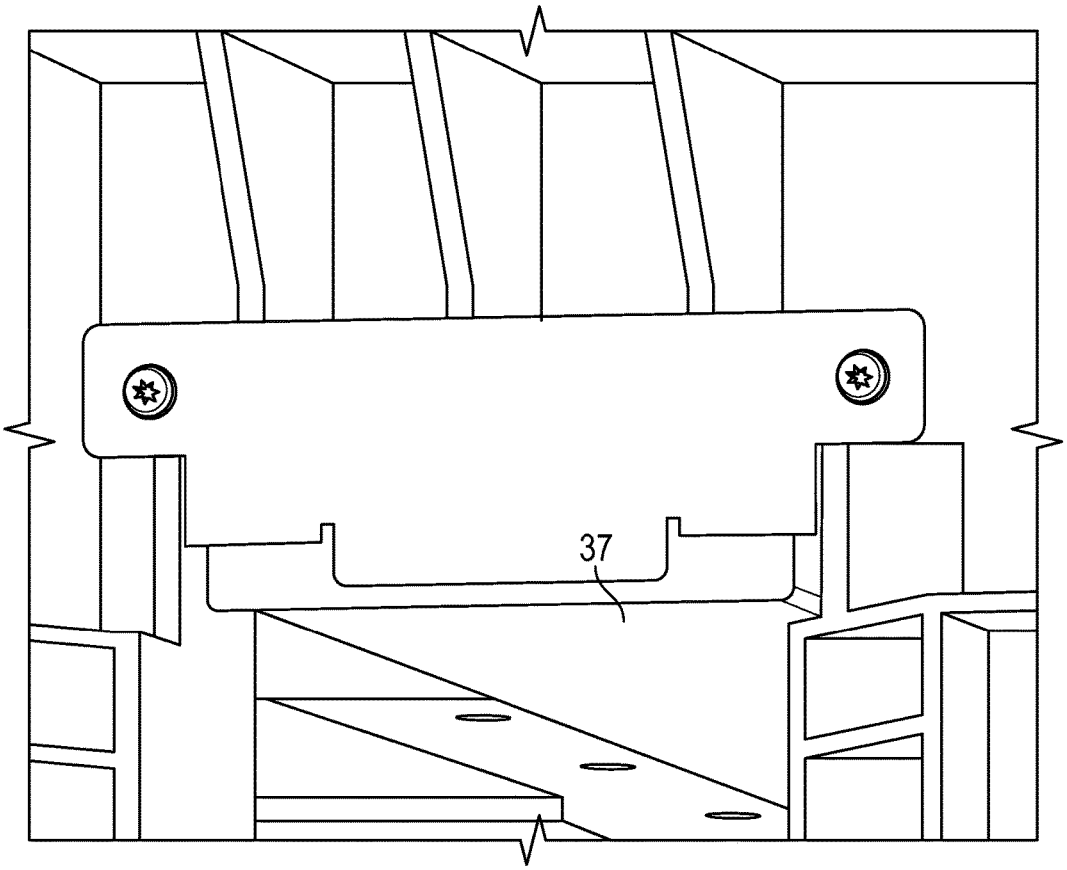
FIG. 9 is a perspective view of beam made in accordance with the present invention.

The dispensing portion 22 also includes a gate assembly 28 for selectively opening and closing a gate 30 to allow for dispensing of materials stored within the bin 10 (FIGS. 6-9). The gate assembly 28 includes the gate 30 and a lock 32. The gate 30 extends through a side wall 24, but may also extend through an end wall 26. The lock 32 is located on the exterior of the side wall 24. The gate 30 covers a discharge opening 34 located in the center of a bottom wall 13 of the dispensing portion 22. To dispense materials, the lock 32 is unlocked by moving the lock 32 as shown in FIG. 8, and the gate 30 is slid outward, thereby allowing materials to dispense through the opening 34. The gate assembly 28 also provides for tamper evidence such as use of a zip tie or other similar device.

The dispensing portion 22 also includes a pair of beams 37 extending between side walls 24 to provide structural integrity when the bin 10 is moved via forklift or other means. The side walls 24 and end walls 26 each include forklift tine openings 39 to provide access to forklift tines to move the bin 10.

Figure 10:
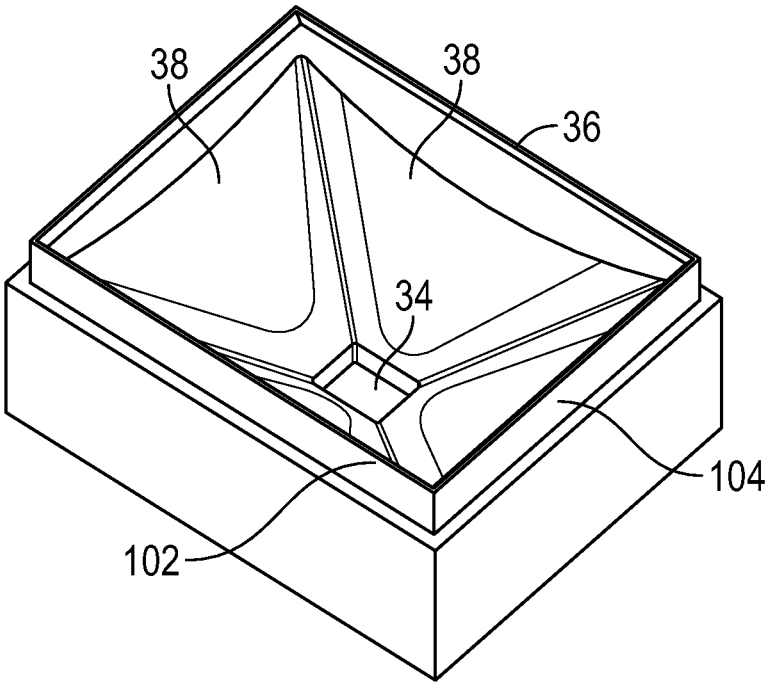
FIG. 10 is a perspective view of a hopper made in accordance with the present invention.

The dispensing portion 22 also includes a hopper 36 disposed within. The hopper 36 includes downwardly angled walls 38. In an existing hopper bin container, the hopper consists of four planar walls that are set at an angle of approximately 35° from horizontal. The intersecting lines between these planar walls are angled approximately 26° from horizontal; this is the minimum angle that seed kernels or other granules have to travel to exit the hopper at the bottom opening. With that in mind, the hopper walls 38 in the current embodiment consist of a planar portion in the corners of the hopper, set at a 35° angle matching existing hopper bins, but the center areas of each hopper wall 38 are curved as shown in FIG. 10. The curvature is such that the minimum discharge angle at any given location is no less than 26°. The curved surfaces of the walls 38 result in a larger fill volume as compared to prior art hoppers without reducing the minimum discharge angle.

Figure 21:
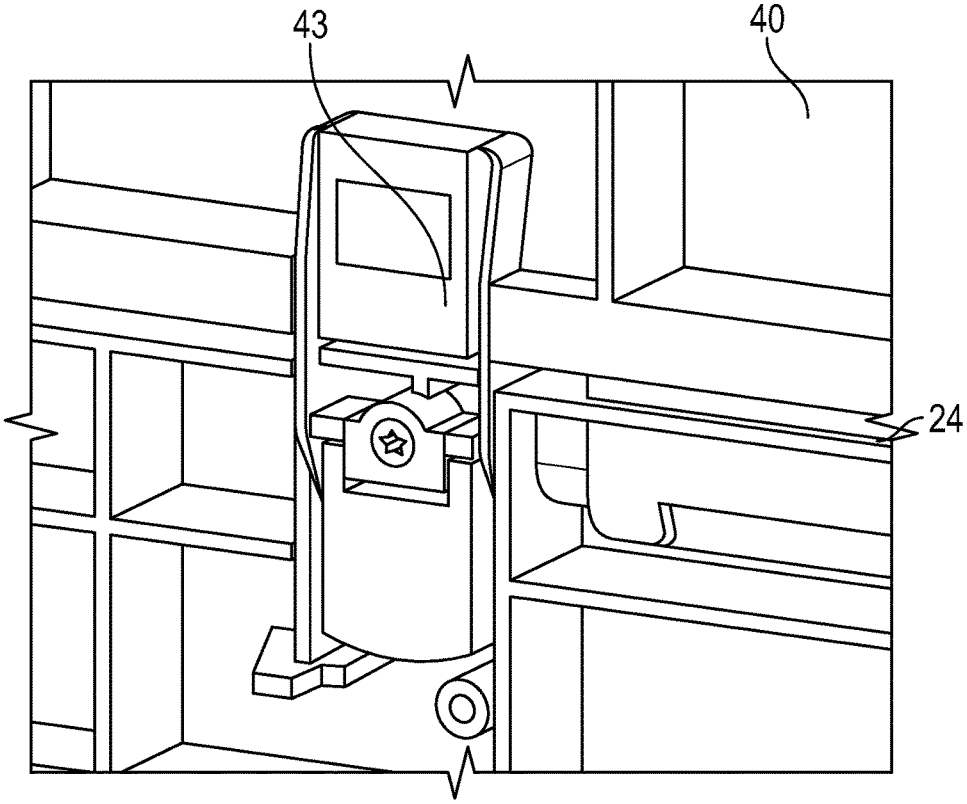
FIG. 21 is perspective view of a latch in accordance with the present invention.

The storage portion 20 includes first and second opposing side walls 40 and first and second opposing end walls 42 hingedly connected to corresponding first and second side walls 24 and first and second end walls 26 of the dispensing portion 22. In the filled position, the storage portion side walls 40 and end walls 42 are vertically upright. In the filled position, the storage portion side walls 40 are locked to the dispensing portion side walls 24 by latches 43 extending between them as shown in FIG. 21. The latches 43 including a clasp 49 attached to the side walls 24 of the dispensing portion 22 that engage with a locking portion 51 on the side walls 40 of the storage portion 20. The latches 43 prevent the side walls 40 of the storage portion from migrating upwards during filling of the storage portion 20. The side walls 40 and end walls 42 include ribs 27 for strength while reducing weight.

In the collapsed state, the side walls 40 and end walls 42 of the storage portion 20 lay horizontally flat along the top of the dispensing portion 22. The first and second end walls 42 rotate about a fixed hinge axis when moved between the open and collapsed positions. The dispensing portion 22 can store materials when the hopper bin 10 is in the collapsed position.

The first and second side walls 40 of the storage portion 20 move vertically upward and then downward during rotation when moved between the open and collapsed positions. The vertical movement creates a waterproof seal between the bottom edges of the side walls 40 and end walls 42 of the storage portion 20 and the top edge of the side walls 24 and end walls 26 of the dispensing portion 22. The waterproof seal is created as follows.

Figure 12:
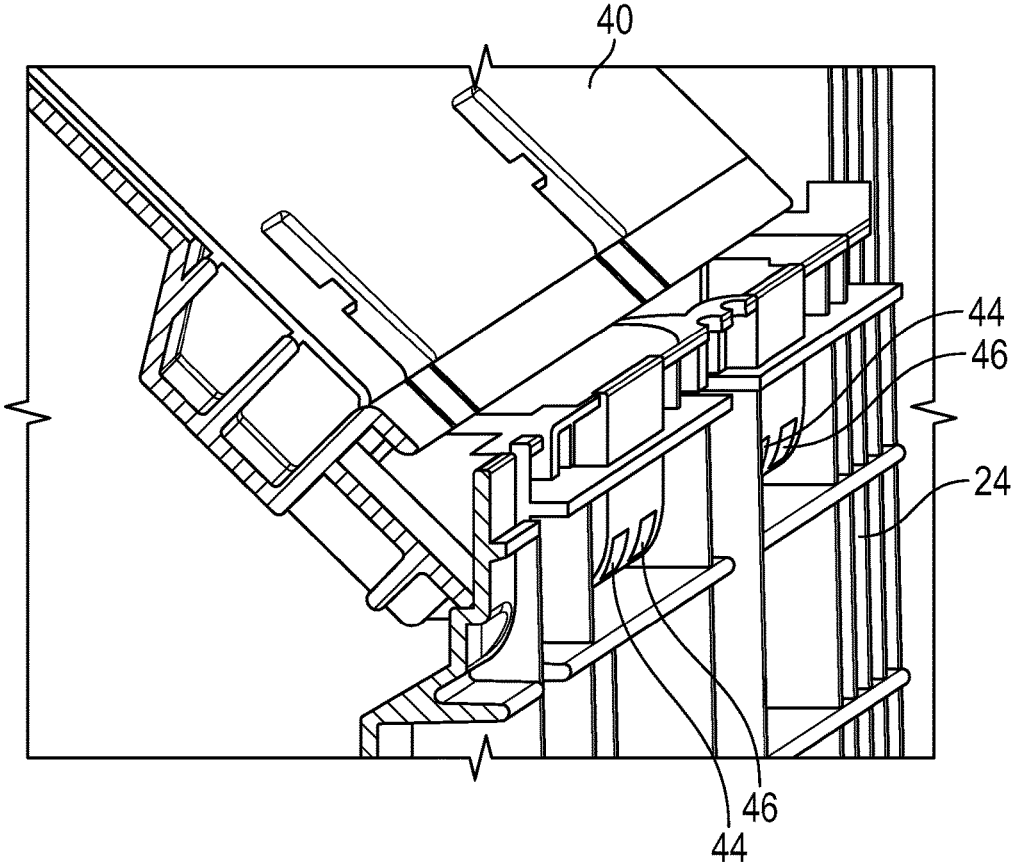
FIG. 12 is a perspective view of a dispensing portion side wall and storage portion side wall between the collapsed and open positions in accordance with the present invention.

The top edge of the side walls 24 of the dispensing portion 22 includes hinge pockets 44 (FIG. 12). Within the hinge pockets 44 are a first plurality of cam elements 46. The cam elements 46 contact the bottom edge of the side walls 40 and raise up the side wall 40 vertically as it is rotated about the hinges towards a vertical position.

Figure 13:
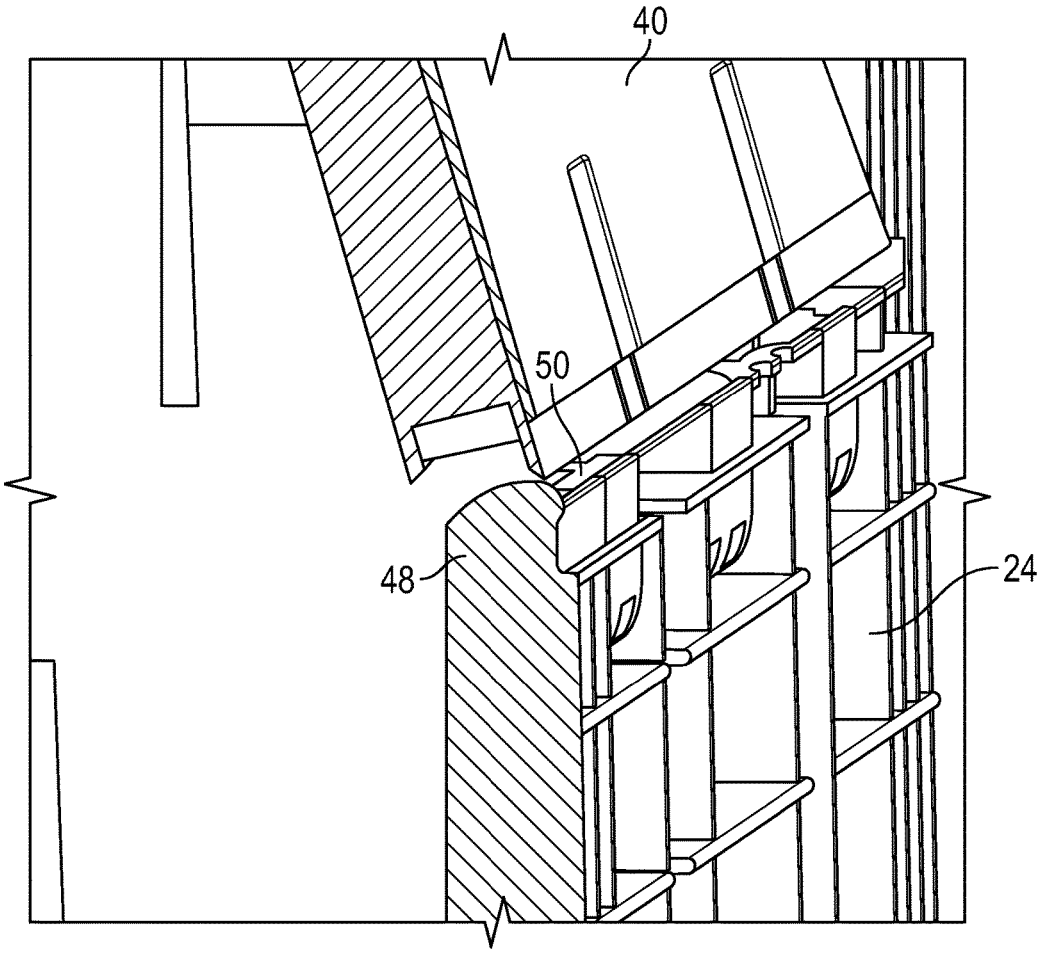
FIG. 13 is a perspective view of a dispensing portion side wall and storage portion side wall between the collapsed and open positions in accordance with the present invention.

The top edge of the side walls 24 also includes a second plurality of cam elements 48 (FIG. 13). When the side wall 40 is raised to an angle of approximately 35°, engaging portions 50 on the lower edge of the side wall 40 engage the cam elements 48. As the engaging portions 50 slide along the cam elements 48, the side wall 40 is raised vertically.

Figure 14:
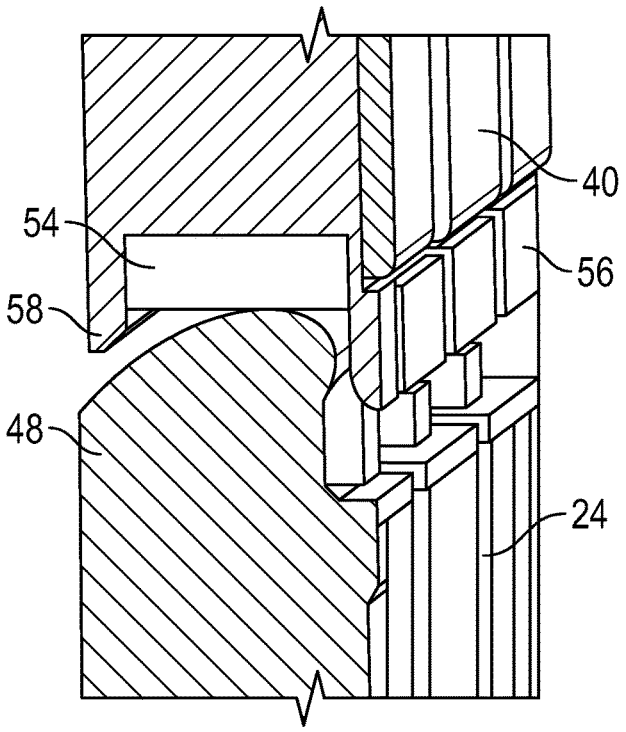
FIG. 14 is a perspective view of a dispensing portion side wall and storage portion side wall between the collapsed and open positions in accordance with the present invention.
Figure 15:
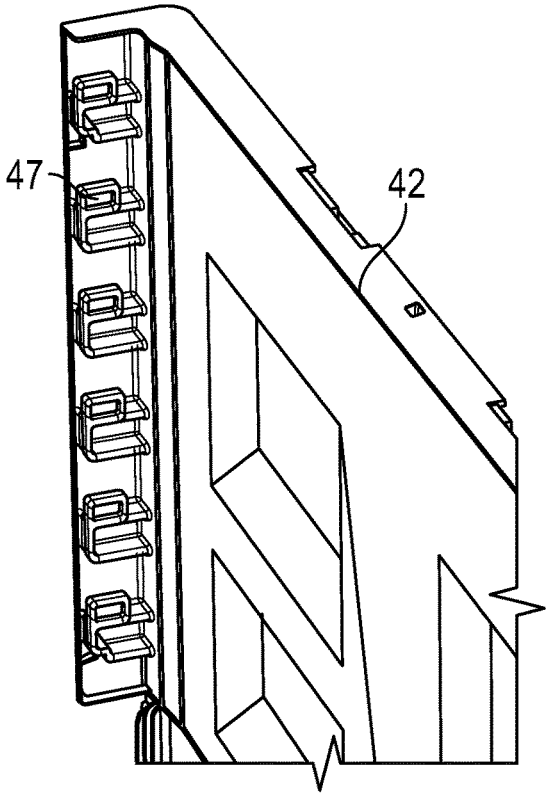
FIG. 15 is a perspective view of an interlock of the storage portion end wall in accordance with the present invention.
Figure 16:
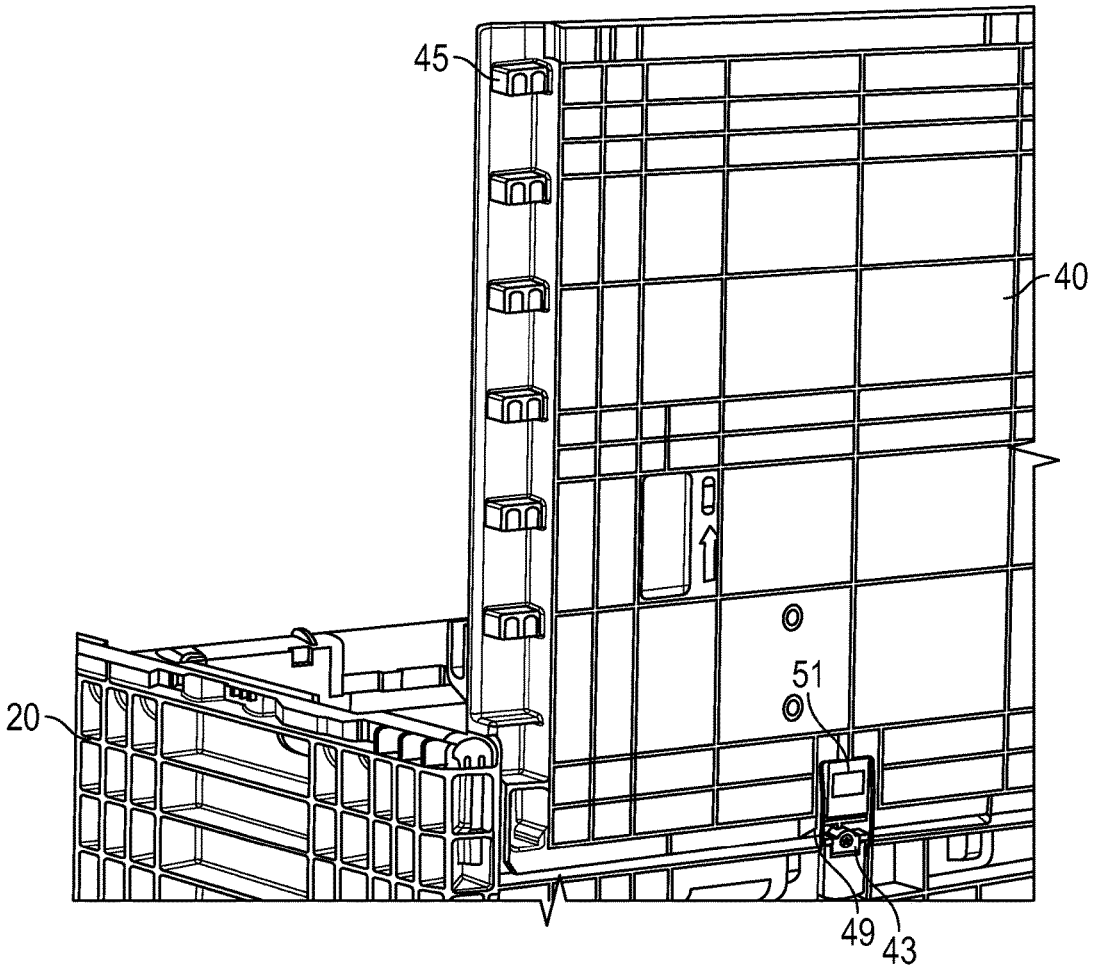
FIG. 16 is a perspective view of an interlock of the storage portion side wall in accordance with the present invention.

When the side wall 40 reaches the vertical position, it is approximately 0.75 inches higher than the end wall 42 (FIG. 14). The side wall 40 is then pushed downward to interlock with the end wall 42. The interlocks 45 and 47 between the side wall 40 and end wall 42 may be of the type shown in U.S. Pat. No. 5,094,356, or any suitable design (FIGS. 15 and 16).

When the side walls 40 and end walls 42 are engaged, a water shield is formed. This water shield is formed between the bottom edges of the side walls 40 and the top edges of the side walls 24. The bottom edge of the side wall 40 includes a channel 54 along the length of the side wall 40. The channel 54 includes an outer first overlap portion 56 and an inner portion 58. When the side wall 40 is pushed downward, outer first overlap portion 56 overlaps the top edge of the side wall 24 to form a water shield. The cam elements 48 sit within the channel 54.

Figure 17:
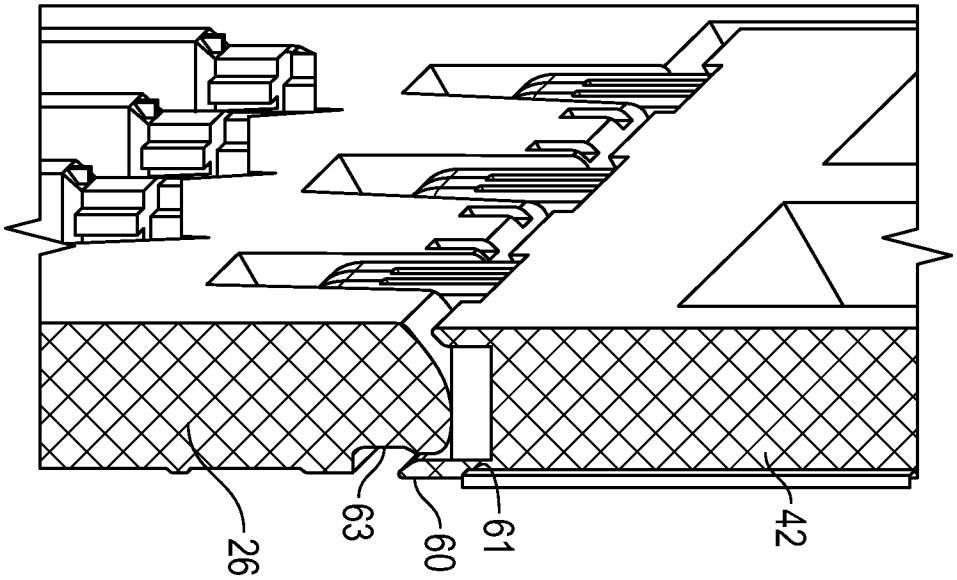
FIG. 17 is a perspective view of a drip edge of the storage portion end wall in accordance with the present invention.
Figure 18:
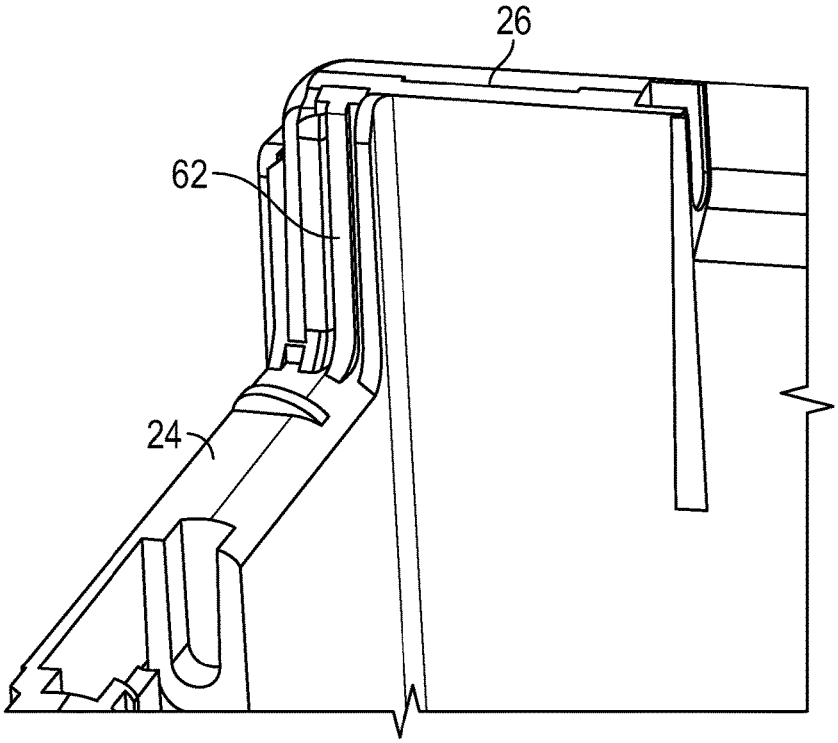
FIG. 18 is a perspective view of a seal at the intersection between the dispensing portion end and side walls in accordance with the present invention.

In addition, end walls 42 include a drip edge 60 on their outer perimeter. The drip edge 60 serves to prevent water intrusion. The drip edge 60 includes a second overlap portion 61 and a gutter 63 (FIG. 17). Seals 62, preferably of rubber, but which can be made of any suitable material, are located on the intersection of the side walls 24 and the end walls 26 on the dispensing portion 22 (FIG. 18). These seals 62 help prevent water intrusion in these corners.

Figure 19:
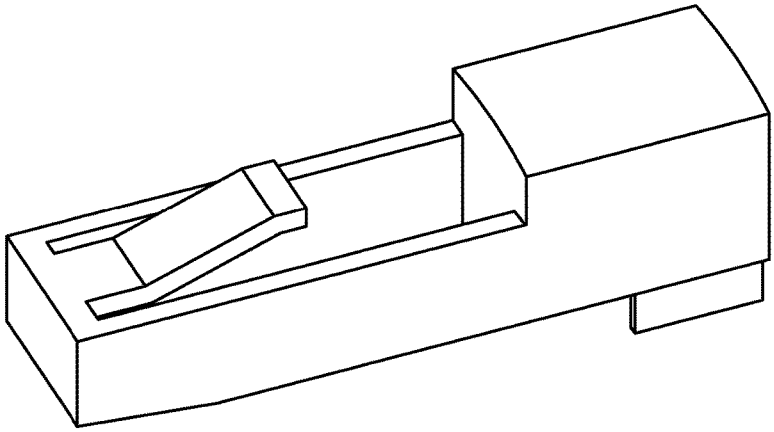
FIG. 19 is a perspective view of a wall lock in accordance with the present invention.
Figure 20:
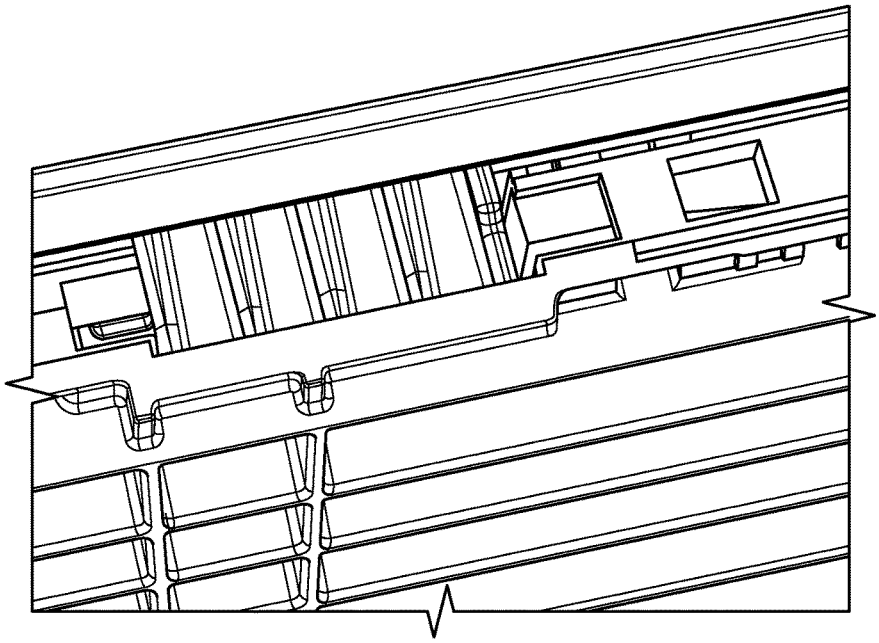
FIG. 20 is a perspective view of a wall lock in place in accordance with the present invention.

The side walls 40 and end walls 42 of the storage portion are hingedly connected to the side walls 24 and end walls 26 of the dispensing portion 22 via slide locks, shown in FIG. 19, which are slid into pockets in the side walls 24 and end walls 26 of the dispensing portion. A flexible cantilevered beam is integrally molded into each slide lock and prevents the locks from backing out on their own. Depressing these beams allows the slide locks to be slid out of their pockets and thus facilitate easy replacement of side walls 40 and end walls 42.

Figure 22:
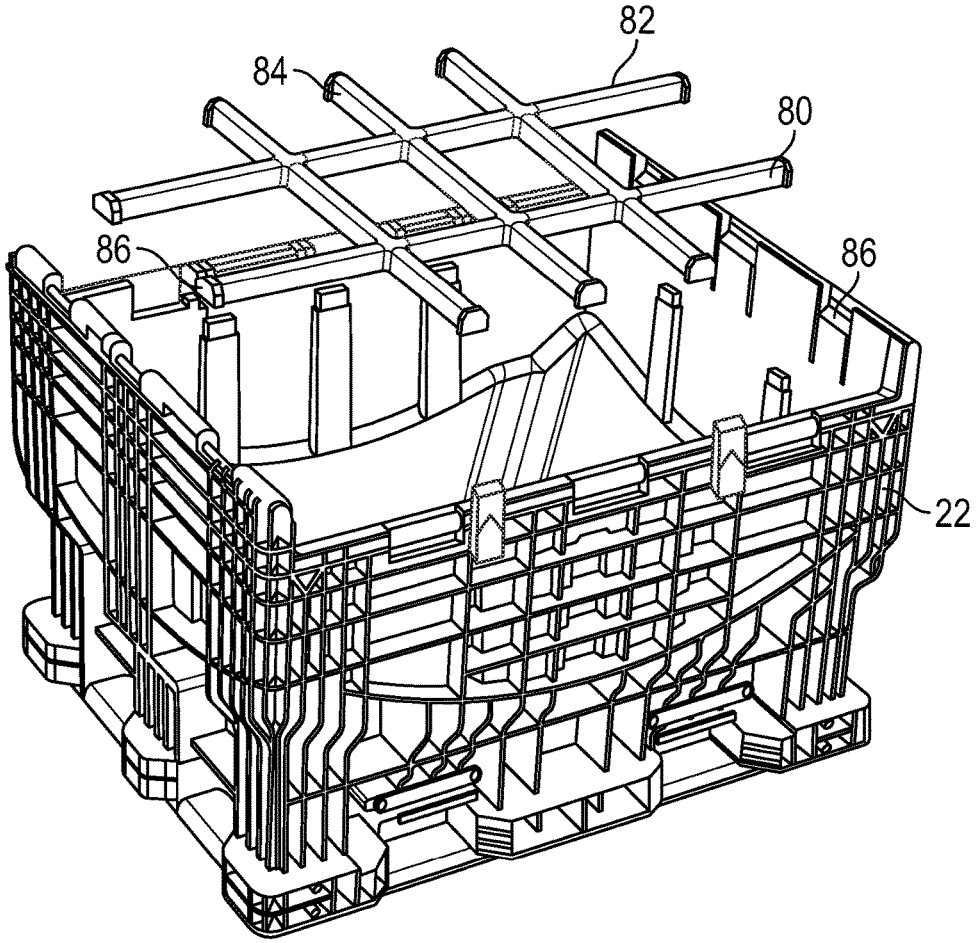
FIG. 22 is a perspective view of a latch in accordance with the present invention.

In addition, a cross brace 80 may be used with the dispensing portion 22 (FIG. 22) to provide additional stability to the bin 10. The cross brace 80 includes intersecting longitudinal and lateral members 82 and 84 formed to engage with corresponding posts 86 located on the dispensing portion 22.

While the specific embodiments have been illustrated and described, numerous modifications come to mind without significantly departing from the spirit of the invention, and the scope of protection is only limited by the scope of the accompanying Claims.

What is claimed is:

1. A collapsible hopper bin comprising:

a dispensing portion, the dispensing portion including:

first and second opposing side walls each having a top edge and a first plurality of cam elements;

first and second opposing end walls;

a storage portion, the storage portion including:

third and fourth opposing side walls each having a bottom edge;

third and fourth opposing end walls;

each of the third and fourth side walls is respectively attached to each of the first and second side walls by a hinge, the third and fourth sidewalls are moveable about the hinge between a horizontal position to a vertical position, the bottom edge being in contact with the first plurality of cam elements and raise the third and fourth sidewalls vertically upon moving from the horizontal position to the vertical position;

one of each of the third and fourth end walls is respectively attached by a hinge to one of each of the first and second end walls; and the collapsible hopper bin having a collapsed position and a filled position, wherein the third and fourth end walls and the third and fourth side walls are substantially horizontally flat along a top of the dispensing portion in the collapsed position.

2. The collapsible hopper bin of claim 1 further comprising at least one means for securing the third and fourth side walls to the first and second side walls in the filled position.

3. The collapsible hopper bin of claim 1 further comprising a hopper within the dispensing portion, the hopper having a plurality of walls with downwardly curved surfaces.

4. The collapsible hopper bin of claim 1 having a gate assembly within the dispensing portion, the gate assembly including a gate and a lock, the gate assembly selectively opening and closing a discharge opening in a bottom of the dispensing portion.

5. The collapsible hopper bin of claim 1 further comprising a pair of beams extending between the first and second side walls.

6. The collapsible hopper bin of claim 1 further comprising a drip edge, the drip edge including a second overlap portion along a bottom edge of the third and fourth end walls and a gutter along a top edge of the first and second end walls.

7. The collapsible hopper bin of claim 3 wherein the downwardly curved surfaces have a minimum discharge angle of at least 26 degrees.

8. The collapsible hopper bin of claim 1 further comprising a seal located at the intersection between a top edge of the dispensing portion side walls and end walls.

9. The collapsible hopper bin of claim 1 wherein the third and fourth side walls include a waterproof seal.

10. A collapsible hopper bin comprising:

a dispensing portion, the dispensing portion including:

first and second opposing side walls each having a first top edge, a second top edge, a first plurality of cam elements at the first top edge and a second plurality of cam elements on the second top edge;

first and second opposing end walls;

a storage portion, the storage portion including:

third and fourth opposing side walls each having a second top edge and a bottom edge;

third and fourth opposing end walls; and each of the third and fourth side walls is respectively attached to each of the first and second side walls by a hinge and are moveable about the hinge between a horizontal position to a vertical position, the bottom edge being in contact with the first plurality of cam elements and the second plurality of cam elements and raise the third and fourth sidewalls vertically upon moving from the horizontal position to the vertical position.

11. The collapsible hopper bin of claim 10 wherein each of the first and second end walls is respectively attached to one of each of the third and fourth end walls.

12. The collapsible hopper bin of claim 10, the collapsible hopper bin having a collapsed position and a filled position, wherein the third and fourth end walls and the third and fourth side walls are substantially horizontally flat along the first top edge in the collapsed position.

13. The collapsible hopper bin of claim 10 having a collapsed position and a filled position, and further comprising at least one means of securing the third and fourth side walls to the first and second side walls in the filled position.

14. The collapsible hopper bin of claim 10 having a collapsed position and a filled position, and further comprising a hopper within the dispensing portion, the hopper having a plurality of walls with downwardly curved surfaces.

15. The collapsible hopper bin of claim 10 having a gate assembly within the dispensing portion, the gate assembly including a gate and a lock, the gate assembly selectively opening and closing a discharge opening in a bottom of the dispensing portion.

16. The collapsible hopper bin of claim 14 wherein the downwardly curved surfaces have a minimum discharge angle of at least 26 degrees.

17. The collapsible hopper bin of claim 10 further comprising a drip edge, the drip edge including a second overlap portion along the bottom edge and a gutter along the first top edge.

18. The collapsible hopper bin of claim 10 further comprising a seal located at the intersection between the first top edge and a third top edge of the first and second end walls.

* * * * *